US008016108B1

(12) United States Patent
Hung

(10) Patent No.: US 8,016,108 B1
(45) Date of Patent: Sep. 13, 2011

(54) TOOL BOX WHOSE TOOL TIPS ARE ROTATED OUTWARD WHEN THE TOOL BOX IS OPENED

(76) Inventor: Tung-Hsu Hung, Taichung Hsien (TW)

( * ) Notice: Subject to any disclaimer, the term of this patent is extended or adjusted under 35 U.S.C. 154(b) by 0 days.

(21) Appl. No.: 12/773,151

(22) Filed: May 4, 2010

(51) Int. Cl.
*B65D 85/20* (2006.01)

(52) U.S. Cl. ..... 206/379; 206/372

(58) Field of Classification Search ..... 206/349, 206/372–379, 745, 747, 749, 756, 759; 220/827
See application file for complete search history.

(56) References Cited

U.S. PATENT DOCUMENTS 6,415,923 B1 * 7/2002 Chen ..... 206/379
6,547,074 B1 * 4/2003 Chen ..... 206/379
7,270,235 B2 * 9/2007 Chen ..... 206/379
2005/0056560 A1 * 3/2005 Chen ..... 206/373
2006/0260963 A1 * 11/2006 Ke ..... 206/349
2008/0053853 A1 * 3/2008 Kao ..... 206/377
2008/0314795 A1 * 12/2008 Lin ..... 206/372
* cited by examiner

*Primary Examiner* — Luan K Bui
(74) *Attorney, Agent, or Firm* — Alan Kamrath; Kamrath & Associates PA

(57) ABSTRACT

A tool box includes a housing, a receiving seat pivotally mounted in the housing and having a side provided with a driven gear, a rotation shaft pivotally mounted on the housing and having a side provided with a drive gear meshing with the driven gear, a restoring unit mounted between the rotation shaft and the housing to rotate the rotation shaft outward relative to the housing, and a top cover mounted on the rotation shaft to rotate the rotation shaft. Thus, when the rotation shaft is rotated by the restoring unit, the drive gear is driven by the rotation shaft to rotate the driven gear which rotates the receiving seat so that the receiving seat is rotated outward relative to the housing to expose the tool tips outward from the housing.

18 Claims, 7 Drawing Sheets

TOOL BOX WHOSE TOOL TIPS ARE ROTATED OUTWARD WHEN THE TOOL BOX IS OPENED

BACKGROUND OF THE INVENTION

1. Field of the Invention

The present invention relates to a box and, more particularly, to a tool box to receive and store hand tools, such as screwdrivers and the like.

2. Description of the Related Art

A conventional tool box comprises a housing having an inner portion provided with a plurality of separation baffles to support hand tools and adapters, a receiving seat mounted in the housing to receive a plurality of tool tips, such as screwdriver tips and the like, and a top cover pivotally mounted on the housing to cover the housing and the receiving seat. The receiving seat protrudes outward from the housing to expose the tool tips to facilitate a user selecting the tool tips. However, the top cover has to correspond to the height of the tool tips and the receiving seat so that the tool box has a greater height, thereby increasing the whole volume of the tool box. In addition, the top cover cannot be removed from the housing automatically so that the user has to apply a force to remove the top cover from the housing manually, thereby causing inconvenience to the user.

BRIEF SUMMARY OF THE INVENTION

In accordance with the present invention, there is provided a tool box, comprising a housing, a receiving seat pivotally mounted in the housing and having a side provided with a driven gear, a rotation shaft pivotally mounted on the housing and having a side provided with a drive gear meshing with the driven gear of the receiving seat, and a top cover mounted on the rotation shaft to rotate the rotation shaft relative to the receiving seat and the housing. The tool box further comprises a restoring unit mounted between the rotation shaft and the housing to rotate the rotation shaft outward relative to the housing and to move the top cover outward relative to the housing.

The primary objective of the present invention is to provide a tool box whose tool tips are rotated outward when the tool box is opened.

According to the primary objective of the present invention, when the rotation shaft is rotated by the restoring unit, the drive gear is driven by the rotation shaft to rotate the driven gear which rotates the receiving seat so that the receiving seat is rotated outward relative to the housing to expose the tool tips outward from the housing to facilitate a user selecting the tool tips.

According to another objective of the present invention, the rotation tube is rotatable relative to the fixed tube by the restoring force of the torsion spring to rotate the rotation shaft which rotates the top cover so that the top cover can be moved outward relative to the housing so as to expose the housing automatically, thereby facilitating the user opening the top cover.

According to a further objective of the present invention, the receiving seat is fully received in and does not protrude outward from the housing when the top cover covers the housing to reduce the whole volume of the tool box largely.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
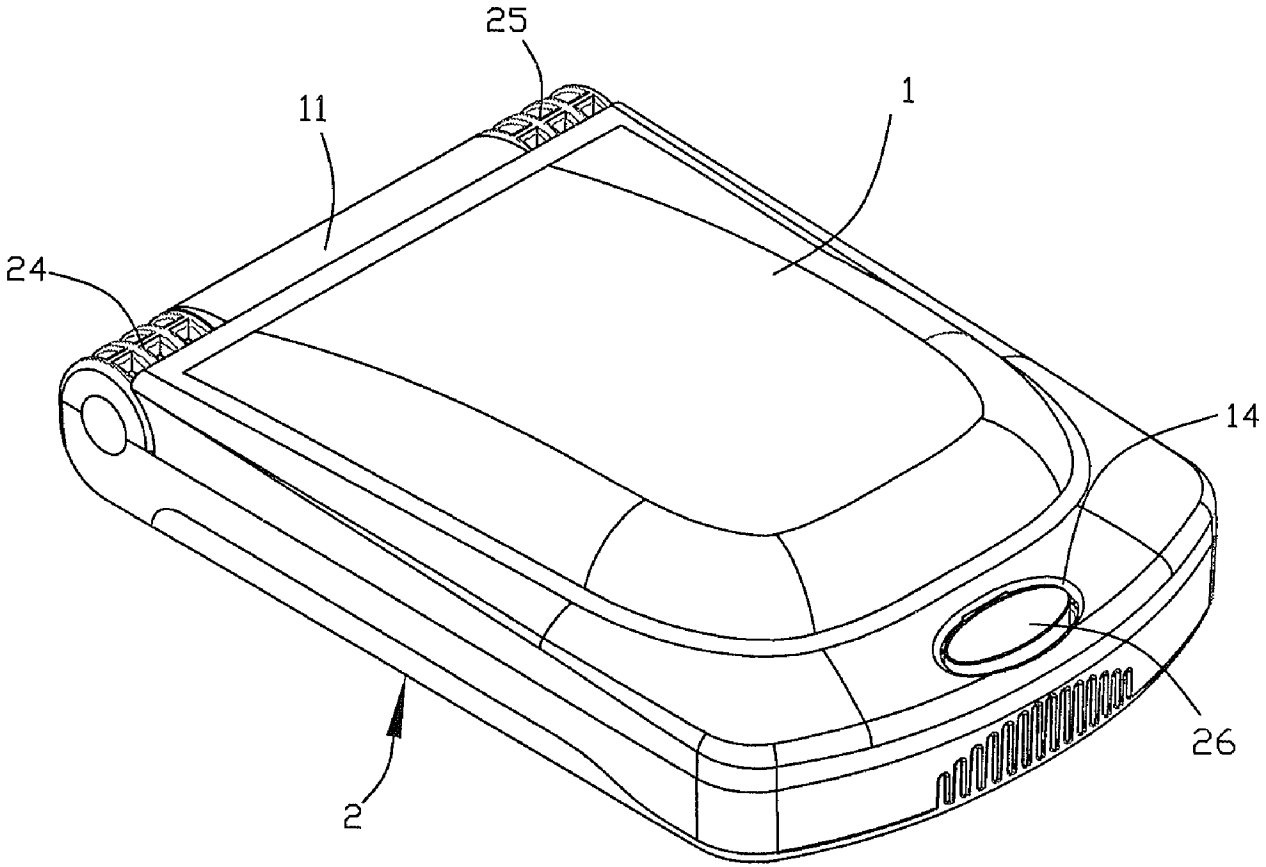
FIG. 1 is a perspective view of a tool box in accordance with the preferred embodiment of the present invention.
Figure 2:
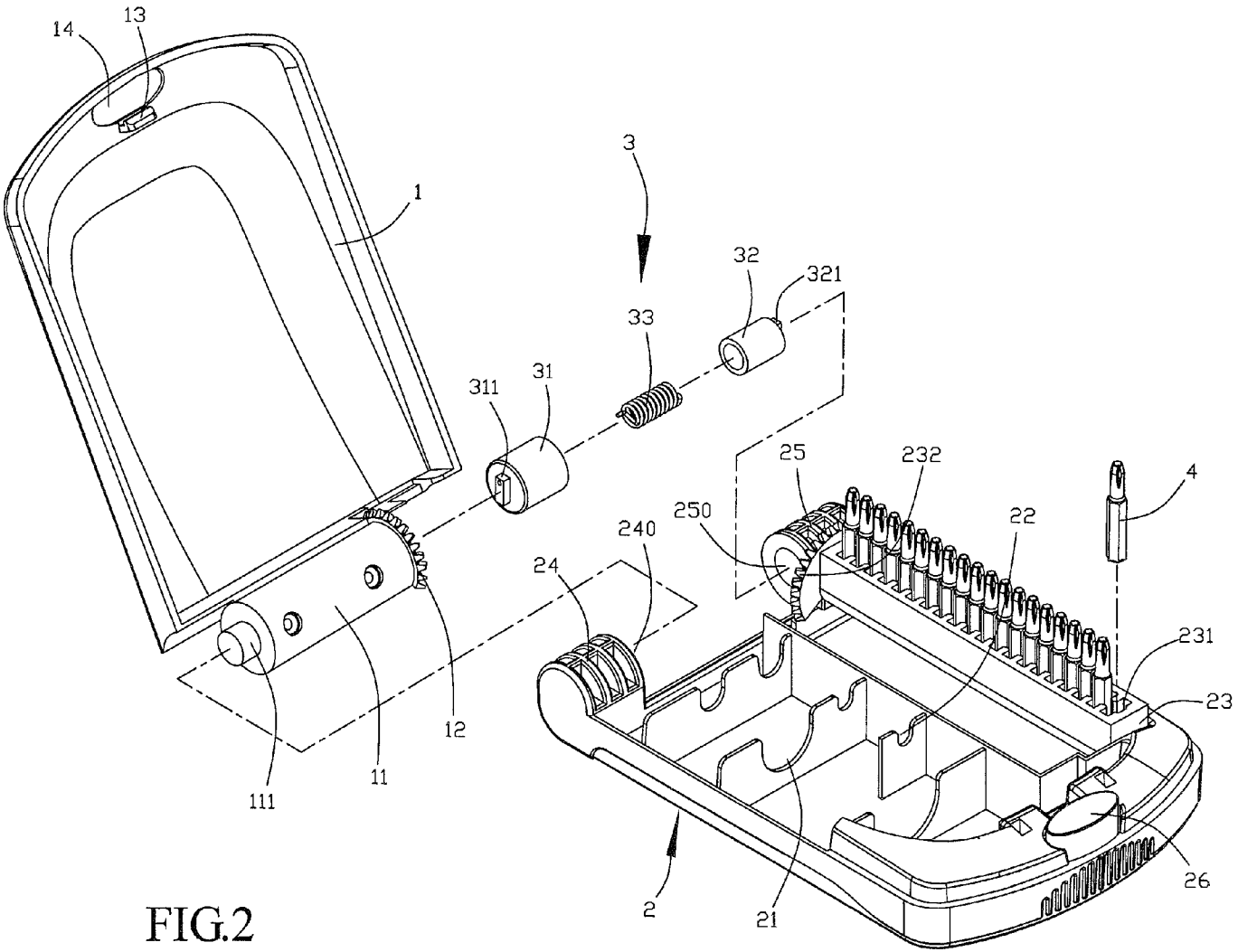
FIG. 2 is an exploded perspective view of the tool box as shown in FIG. 1.

Referring to the drawings and initially to FIGS. 1-4, a tool box in accordance with the preferred embodiment of the present invention comprises a housing 2, a receiving seat 23 pivotally mounted in the housing 2 and having a side provided with a driven gear 232, a rotation shaft 11 pivotally mounted on the housing 2 and having a side provided with a drive gear 12 meshing with the driven gear 232 of the receiving seat 23, and a top cover 1 mounted on the rotation shaft 11 to rotate the rotation shaft 11 relative to the receiving seat 23 and the housing 2.

The housing 2 has an inner portion provided with at least one first support rack 21 to support a hand tool and at least one second support rack 22 to support an adapter. The housing 2 has a first end provided with a first mounting sleeve 25 and a second mounting sleeve 24 spaced from the first mounting sleeve 25. The first mounting sleeve 25 of the housing 2 has an inner portion formed with a first shaft hole 250. The second mounting sleeve 24 of the housing 2 has an inner portion formed with a second shaft hole 240 facing the first shaft hole 250 of the first mounting sleeve 25.

The receiving seat 23 has a rectangular shape and has an inner portion formed with a plurality of slots 231 to allow insertion of a plurality of tool tips 4, such as screwdriver tips. The receiving seat 23 is perpendicular to the rotation shaft 11. The driven gear 232 of the receiving seat 23 is a bevel gear and is perpendicular to the drive gear 12 of the rotation shaft 11.

Figure 5:
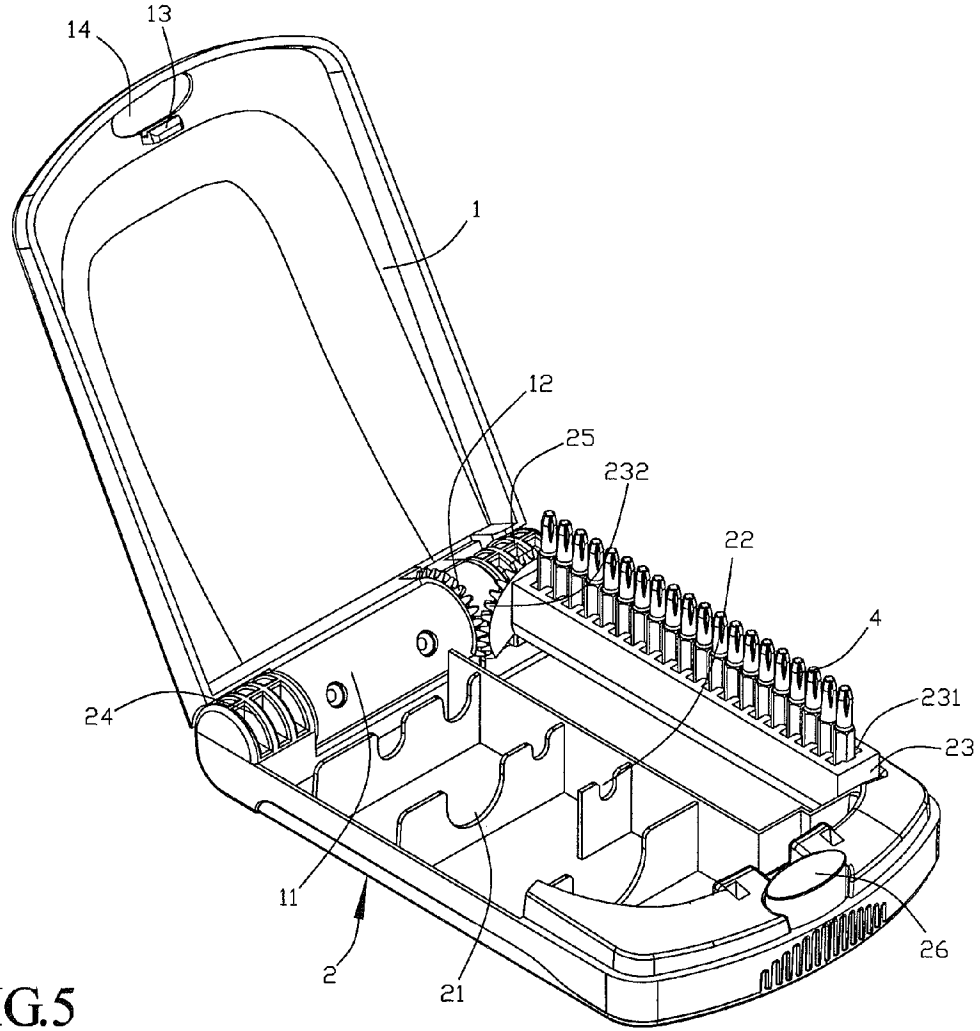
FIG. 5 is a schematic operational view of the tool box as shown in FIG. 1 in use.

When in use, the receiving seat 23 is movable relative to the housing 2 between a first position where the top cover 1 covers the housing 2, and the receiving seat 23 is fully received in and does not protrude outward from the housing 2 to hidden the slots 231 and the tool tips 4 in the housing 2, and a second position where the top cover 1 is removed from the housing 2, and the receiving seat 23 protrudes outward from the housing 2 to expose the slots 231 and the tool tips 4 from the housing 2 as shown in FIG. 5.

The rotation shaft 11 is rotatably mounted between the first mounting sleeve 25 and the second mounting sleeve 24 of the housing 2. The rotation shaft 11 has a first end provided with a rotation rod 111 rotatably mounted in the second shaft hole 240 of the second mounting sleeve 24 and a second end formed with a fixing hole 112. The rotation rod 111 has a diameter smaller than that of the rotation shaft 11. The drive gear 12 of the rotation shaft 11 is a bevel gear.

The tool box further comprises a restoring unit 3 mounted between the rotation shaft 11 and the housing 2 to rotate the rotation shaft 11 outward relative to the housing 2 and to move the top cover 1 outward relative to the housing 2.

The restoring unit 3 includes a fixed tube 32 secured in the first shaft hole 250 of the first mounting sleeve 25, a rotation tube 31 secured in the rotation shaft 11 to rotate in concert with the rotation shaft 11 and rotatably mounted on the fixed tube 32 and a torsion spring 33 biased between the fixed tube 32 and the rotation tube 31. The rotation tube 31 of the restoring unit 3 has an end face provided with a fixing flange 311 secured in the fixing hole 112 of the rotation shaft 11. The fixed tube 32 of the restoring unit 3 is received in the rotation tube 31 and has an end face provided with a fixing rib 321 secured in the first shaft hole 250 of the first mounting sleeve 25. The torsion spring 33 of the restoring unit 3 is fully located between the fixed tube 32 and the rotation tube 31 and has a first end secured in the fixed tube 32 and a second end secured in the rotation tube 31.

The top cover 1 is pivotable relative to the housing 2 to close or open the housing 2. The top cover 1 has a first end secured on the rotation shaft 11 to rotate the rotation shaft 11 and a second end formed with an elongate opening 14 and a locking hook 13 located beside the opening 14.

The tool box further comprises a locking button 26 pivotally mounted on a second end of the housing 2 and releasably locked onto the locking hook 13 of the top cover 1 to removably lock the top cover 1 onto the housing 2, and an elastic member 27 mounted in the second end of the housing 2 and biased between the housing 2 and the locking button 26 to push the locking button 26 toward the locking hook 13 of the top cover 1.

The locking button 26 extends through and protrudes outward from the opening 14 of the top cover 1. The locking button 26 has a first end provided with a locking piece 260 detachably locked onto the locking hook 13 of the top cover 1 and a second end pressing the elastic member 27. The locking button 26 has a mediate portion provided with a pivot ear 261 pivotally mounted in the second end of the housing 2. The pivot ear 261 of the locking button 26 is disposed between the locking piece 260 and the elastic member 27. The elastic member 27 is biased between the second end of the housing 2 and the second end of the locking button 26 to push the locking piece 260 of the locking button 26 toward the locking hook 13 of the top cover 1.

Figure 3:
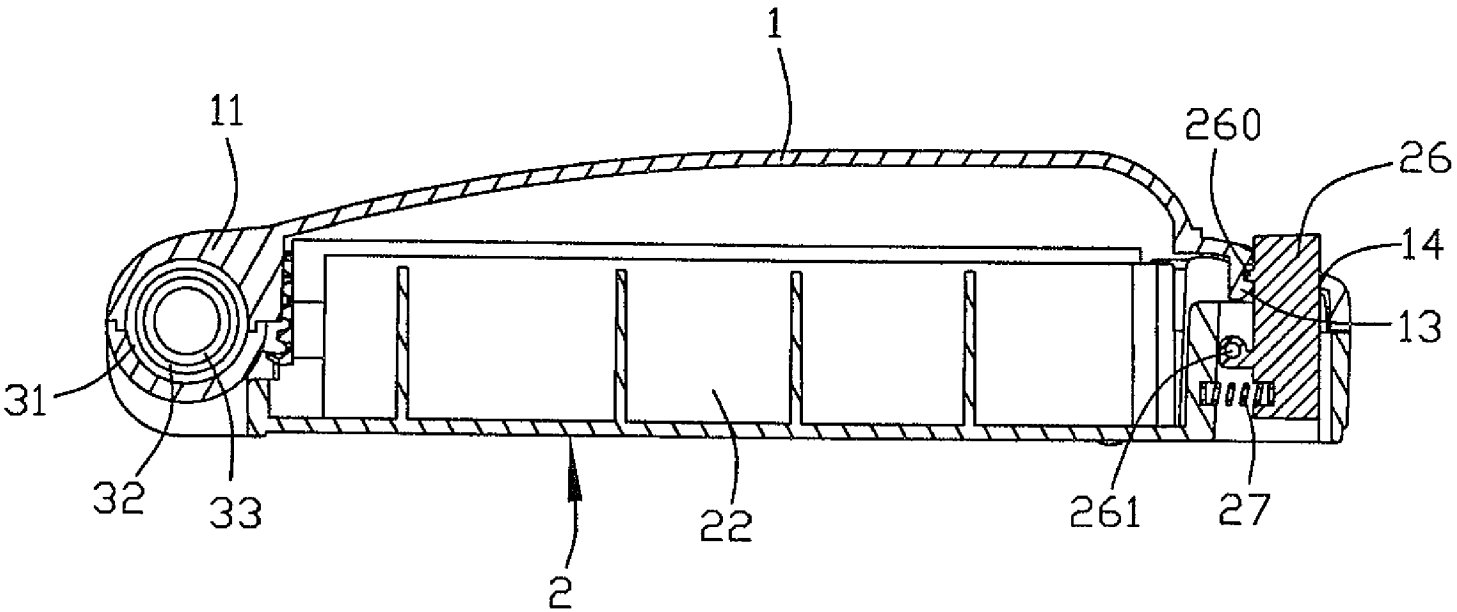
FIG. 3 is a side cross-sectional view of the tool box as shown in FIG. 1.
Figure 4:
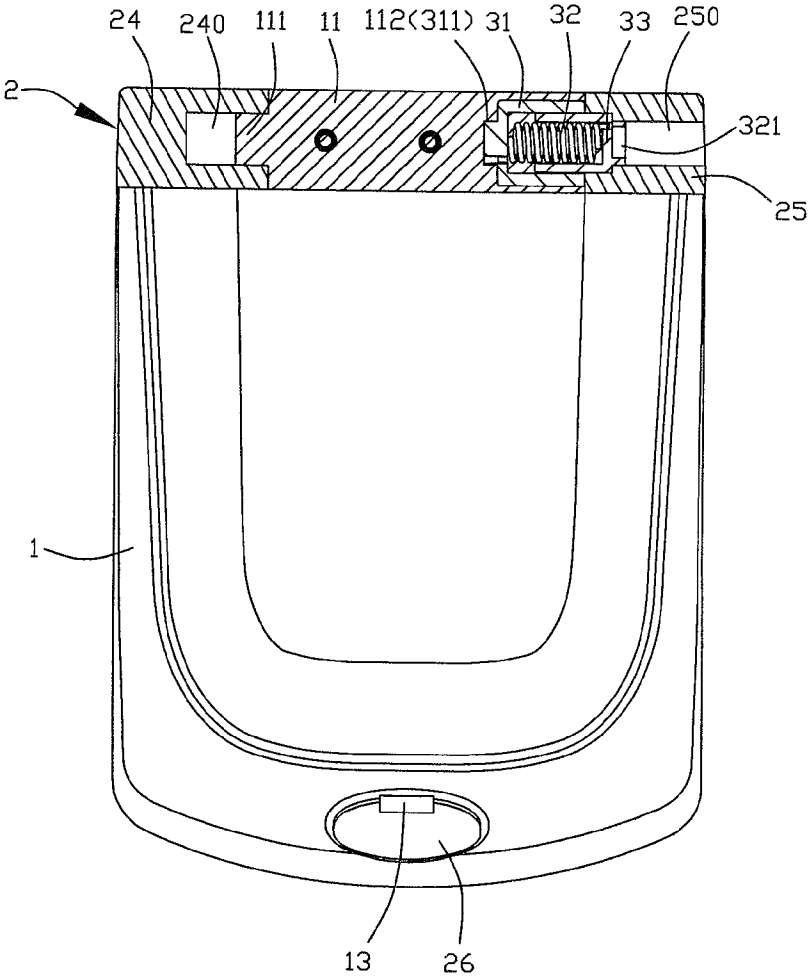
FIG. 4 is a top cross-sectional view of the tool box as shown in FIG. 1.
Figure 6:
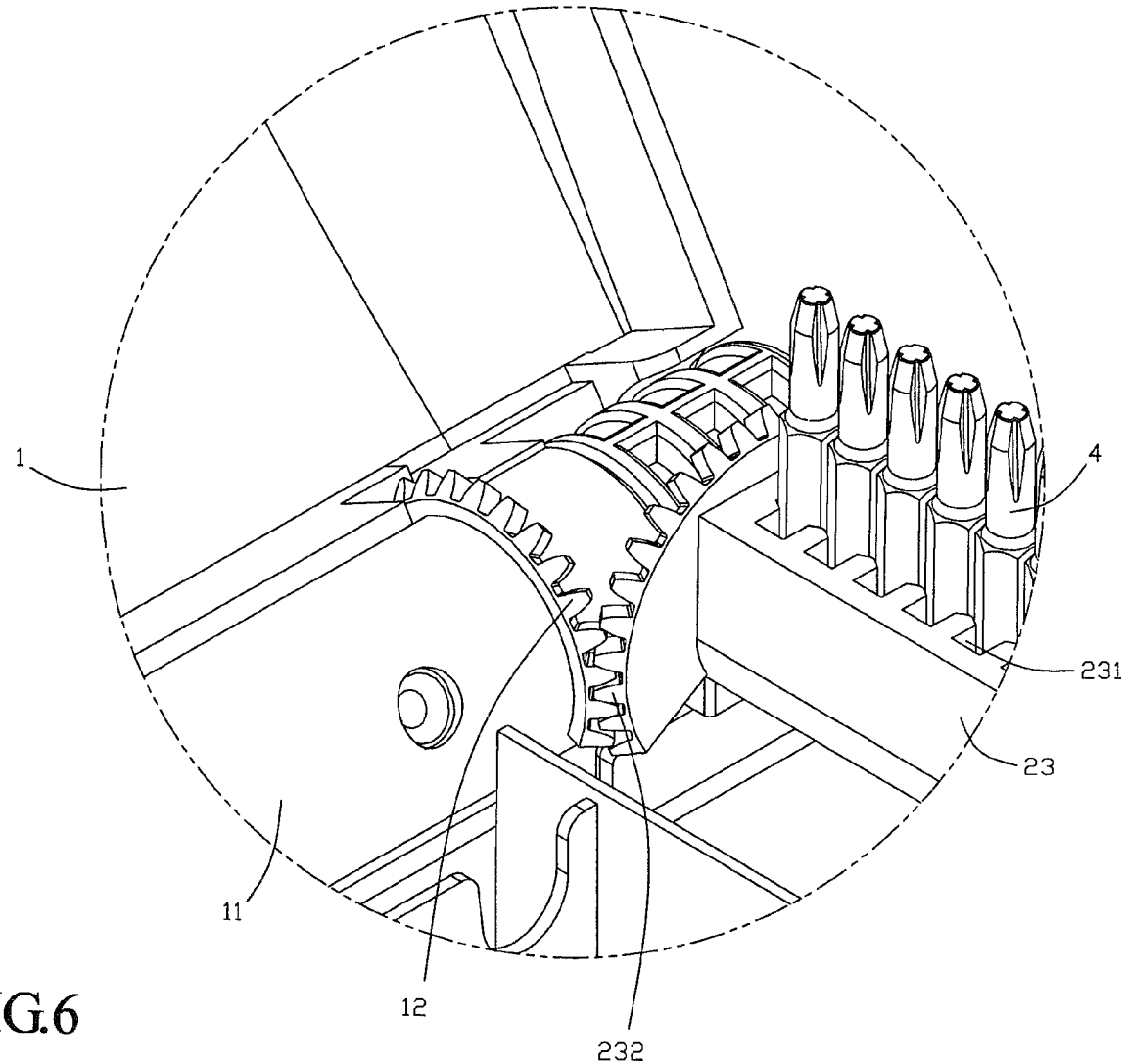
FIG. 6 is a locally enlarged view of the tool box as shown in FIG. 5.
Figure 7:
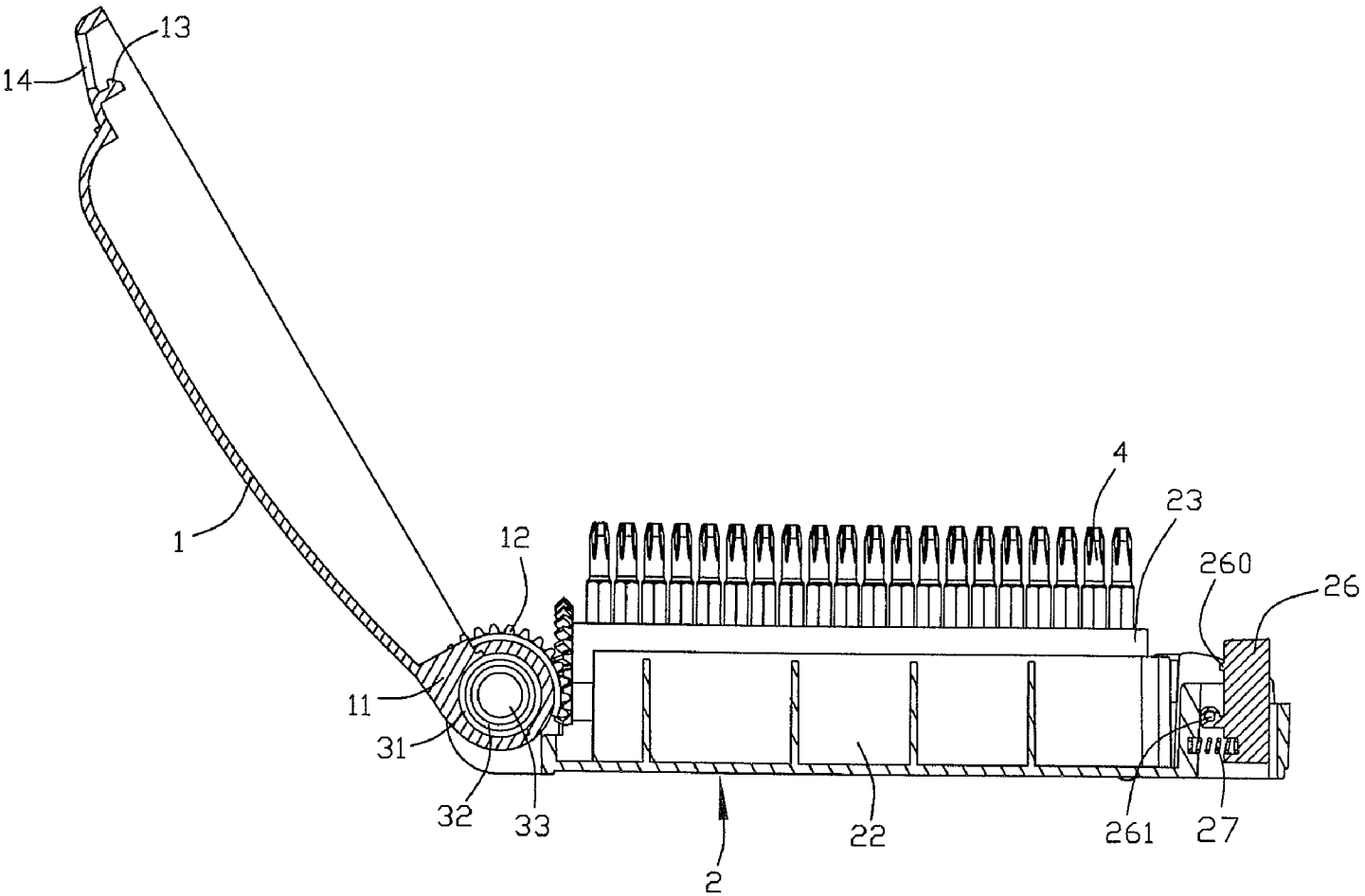
FIG. 7 is a side cross-sectional view of the tool box as shown in FIG. 6.

In operation, referring to FIGS. 5-7 with reference to FIGS. 1-4, the locking piece 260 of the locking button 26 is locked onto the locking hook 13 of the top cover 1 as shown in FIG. 3 to lock the top cover 1 onto the housing 2. When the locking button 26 is pivoted outward relative to the locking hook 13 of the top cover 1, the locking piece 260 of the locking button 26 is detached from the locking hook 13 of the top cover 1 to unlock the top cover 1 from the housing 2 so that the top cover 1 can be removed from the housing 2. At this time, the rotation tube 31 is rotatable relative to the fixed tube 32 by the restoring force of the torsion spring 33 to rotate the rotation shaft 11 which rotates the top cover 1 so that the top cover 1 can be moved outward relative to the housing 2 from the position as shown in FIG. 3 to the position as shown in FIG. 7 to open the housing 2 automatically. At the same time, when the rotation shaft 11 is rotated, the drive gear 12 is driven by the rotation shaft 11 to rotate the driven gear 232 which rotates the receiving seat 23 shown in FIG. 6 so that the receiving seat 23 is rotated outward relative to the housing 2 to expose the tool tips 4 outward from the housing 2 shown in FIG. 5 to facilitate a user selecting the tool tips 4.

Accordingly, when the rotation shaft 11 is rotated by the restoring unit 3, the drive gear 12 is driven by the rotation shaft 11 to rotate the driven gear 232 which rotates the receiving seat 23 so that the receiving seat 23 is rotated outward relative to the housing 2 to expose the tool tips 4 outward from the housing 2 to facilitate a user selecting the tool tips 4. In addition, the rotation tube 31 is rotatable relative to the fixed tube 32 by the restoring force of the torsion spring 33 to rotate the rotation shaft 11 which rotates the top cover 1 so that the top cover 1 can be moved outward relative to the housing 2 so as to expose the housing 2 automatically, thereby facilitating the user opening the top cover 1. Further, the receiving seat 23 is fully received in and does not protrude outward from the housing 2 when the top cover 1 covers the housing 2 to reduce the whole volume of the tool box largely.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool box, comprising:

a housing, a receiving seat pivotally mounted in the housing and having a side provided with a driven gear, a rotation shaft pivotally mounted on the housing and having a side provided with a drive gear meshing with the driven gear of the receiving seat, and a top cover mounted on the rotation shaft to rotate the rotation shaft relative to the receiving seat and the housing, wherein the housing has a first end provided with a first mounting sleeve and a second mounting sleeve spaced from the first mounting sleeve;

the rotation shaft is rotatably mounted between the first mounting sleeve and the second mounting sleeve of the housing;

the tool box further comprises a restoring unit mounted between the rotation shaft and the housing to rotate the rotation shaft outward relative to the housing and to move the top cover outward relative to the housing.

2. The tool box of claim 1, wherein the first mounting sleeve of the housing has an inner portion formed with a first shaft hole;

the restoring unit includes:

a fixed tube secured in the first shaft hole of the first mounting sleeve;

a rotation tube secured in the rotation shaft to rotate in concert with the rotation shaft and rotatably mounted on the fixed tube;

a torsion spring biased between the fixed tube and the rotation tube.

3. The tool box of claim 2, wherein the second mounting sleeve of the housing has an inner portion formed with a second shaft hole facing the first shaft hole of the first mounting sleeve;

the rotation shaft has a first end provided with a rotation rod rotatably mounted in the second shaft hole of the second mounting sleeve and a second end formed with a fixing hole;

the rotation tube of the restoring unit has an end face provided with a fixing flange secured in the fixing hole of the rotation shaft.

4. The tool box of claim 2, wherein the fixed tube of the restoring unit has an end face provided with a fixing rib secured in the first shaft hole of the first mounting sleeve.

5. The tool box of claim 3, wherein the rotation rod has a diameter smaller than that of the rotation shaft.

6. The tool box of claim 2, wherein the fixed tube of the restoring unit is received in the rotation tube.

7. The tool box of claim 2, wherein the torsion spring of the restoring unit is fully located between the fixed tube and the rotation tube.

8. The tool box of claim 2, wherein the torsion spring of the restoring unit has a first end secured in the fixed tube and a second end secured in the rotation tube.

9. The tool box of claim 1, wherein the receiving seat has an inner portion formed with a plurality of slots to allow insertion of a plurality of tool tips.

10. The tool box of claim 9, wherein the receiving seat is movable relative to the housing between a first position where the top cover covers the housing, and the receiving seat is fully received in and does not protrude outward from the housing to hidden the slots and the tool tips in the housing, and a second position where the top cover is removed from the housing, and the receiving seat protrudes outward from the housing to expose the slots and the tool tips from the housing.

11. The tool box of claim 1, wherein the receiving seat is perpendicular to the rotation shaft;

the driven gear of the receiving seat is perpendicular to the drive gear of the rotation shaft.

12. The tool box of claim 1, wherein the housing has an inner portion provided with at least one first support rack and at least one second support rack.

13. The tool box of claim 1, wherein the driven gear of the receiving seat is a bevel gear;

the drive gear of the rotation shaft is a bevel gear.

14. A tool box, comprising:

a housing;

a receiving seat pivotally mounted in the housing and having a side provided with a driven ear;

a rotation shaft pivotally mounted on the housing and having a side provided with a drive ear meshing with the driven ear of the receiving seat;

a top cover mounted on the rotation shaft to rotate the rotation shaft relative to the receiving seat and the housing;

wherein the housing has a first end provided with a first mounting sleeve and a second mounting sleeve spaced from the first mounting sleeve;

the rotation shaft is rotatably mounted between the first mounting sleeve and the second mounting sleeve of the housing;

the top cover is pivotable relative to the housing to close or open the housing;

the top cover has a first end secured on the rotation shaft to rotate the rotation shaft and a second end formed with an elongate opening and a locking hook located beside the opening;

the tool box further comprises:

a locking button pivotally mounted on a second end of the housing and releasably locked onto the locking hook of the top cover to removably lock the top cover onto the housing;

an elastic member mounted in the second end of the housing and biased between the housing and the locking button to push the locking button toward the locking hook of the top cover.

15. The tool box of claim 14, wherein the locking button extends through and protrudes outward from the opening of the top cover.

16. The tool box of claim 14, wherein the locking button has a first end provided with a locking piece detachably locked onto the locking hook of the top cover and a second end pressing the elastic member;

the elastic member is biased between the second end of the housing and the second end of the locking button to push the locking piece of the locking button toward the locking hook of the top cover.

17. The tool box of claim 16, wherein the locking button has a mediate portion provided with a pivot ear pivotally mounted in the second end of the housing.

18. The tool box of claim 17, wherein the pivot ear of the locking button is disposed between the locking piece and the elastic member.

* * * * *